United States Patent [19]

Hamid

[11] 4,447,811

[45] May 8, 1984

[54] DIELECTRIC LOADED HORN ANTENNAS HAVING IMPROVED RADIATION CHARACTERISTICS

[75] Inventor: Michael Hamid, Winnipeg, Canada

[73] Assignee: The United States of America as represented by the Secretary of the Navy, Washington, D.C.

[21] Appl. No.: 315,331

[22] Filed: Oct. 26, 1981

[51] Int. Cl.[3] ..... H01Q 13/02

[52] U.S. Cl. ..... 343/783; 343/786

[58] Field of Search ..... 343/753, 755, 783, 854, 343/760, 872, 786

[56] References Cited

U.S. PATENT DOCUMENTS

| | | | |
|---|---|---|---|
| 2,460,401 | 2/1949 | Southworth | 343/760 |
| 2,577,463 | 12/1951 | Hansell | 343/872 |
| 3,611,392 | 10/1971 | Knox | 343/755 |

FOREIGN PATENT DOCUMENTS

| | | | |
|---|---|---|---|
| 903479 | 7/1949 | Fed. Rep. of Germany | 343/753 |
| 54-4049 | 1/1979 | Japan | 343/783 |

*Primary Examiner*—Eli Lieberman
*Assistant Examiner*—Michael C. Wimer
*Attorney, Agent, or Firm*—R. F. Beers; Charles D. B. Curry; George L. Craig

[57] ABSTRACT

An H-plane sectoral horn antenna is loaded with low-loss dielectric inserts in alternative embodiments so as to reduce beamwidth, increase axial gain and to achieve non-mechanical beam scanning. In one embodiment, the antenna is transversely loaded with a multi-layer dielectric array containing an air gap of critical thickness between four dielectric strips. In another embodiment, the antenna is longitudinally and symmetrically loaded with wedge-shaped dielectric strips separated by a critical air gap between the dielectric and antenna walls.

3 Claims, 5 Drawing Figures

DIELECTRIC LOADED HORN ANTENNAS HAVING IMPROVED RADIATION CHARACTERISTICS

BACKGROUND OF THE INVENTION

1. Field of the Invention

The invention relates generally to improving some radiation characteristics of horn antennas by loading the antennas with low-loss dielectrics. More specifically, the invention relates to horn antennas loaded in the transverse plane and in the longitudinal plane with low-loss dielectrics in order to improve beam sharpening, axial gain and other radiation characteristics. The invention also relates to a line-of-sight portable communication system employing the characteristics of dielectric-loaded horn antennas.

2. Description of Prior Art

Antennas are broadly grouped into two categories, wire or aperture antennas. Aperture antennas are those having a feed waveguide and an antenna characterized by the geometry of the aperture, such as parabolic, conical, horn, etc. The bulk of conventional aperture antenna design has concentrated on unloaded antennas, that is, where the aperture has no insert of any kind within the aperture. However, where the disadvantages of dielectric inserts, such as higher side lobe level or increased frequency sensitivity can be tolerated, dielectric loading can provide beam narrowing, lowered input voltage standing wave ratio (VSWR) and non-mechanical beam scanning. The critical parameters when designing dielectric loaded antennas are the dimensions, shape, volume, dielectric constant homogeneity, location and orientation of the insert(s) within the antenna of use. Although the foregoing is broadly applicable to all aperture antennas, the present invention is primarily concerned with improved designs of H-plane sectoral horn antennas loaded either with arrays of dielectric slabs in the transverse direction i.e., perpendicular to direction of electromagnetic propagation, or with dielectric wedges in the longitudinal direction. In each embodiment, addition of the dielectric attenuates radiation power but serves to increase efficiency of the attenuated radiation power.

SUMMARY OF THE INVENTION

Briefly described, an H-plane sectoral horn antenna is loaded with low-loss dielectric inserts to obtain improved beam narrowing, axial gain, and non-mechanical bean scanning. In one embodiment, the antenna is transversely loaded with a multi-layer dielectric array containing an air gap. In another embodiment, the antenna is longitudinally loaded with dielectric strips along the antenna walls and separated from the walls by a critical air gap.

A primary object of invention is to improve the radiation characteristics of an aperture antenna by dielectric loading. Another object of invention is to provide improved axial gain, beam narrowing, input voltage standing wave ratio and non-mechanical beam scanning of an H-plane sectoral horn antenna by means of dielectric loading. Yet another object of invention is to provide a novel line-of-sight communication system using dielectric loaded antennas. Other advantages and objects of invention will become apparent from the following detailed description and original drawings.

DESCRIPTION OF THE PREFERRED EMBODIMENT

Figure 1:
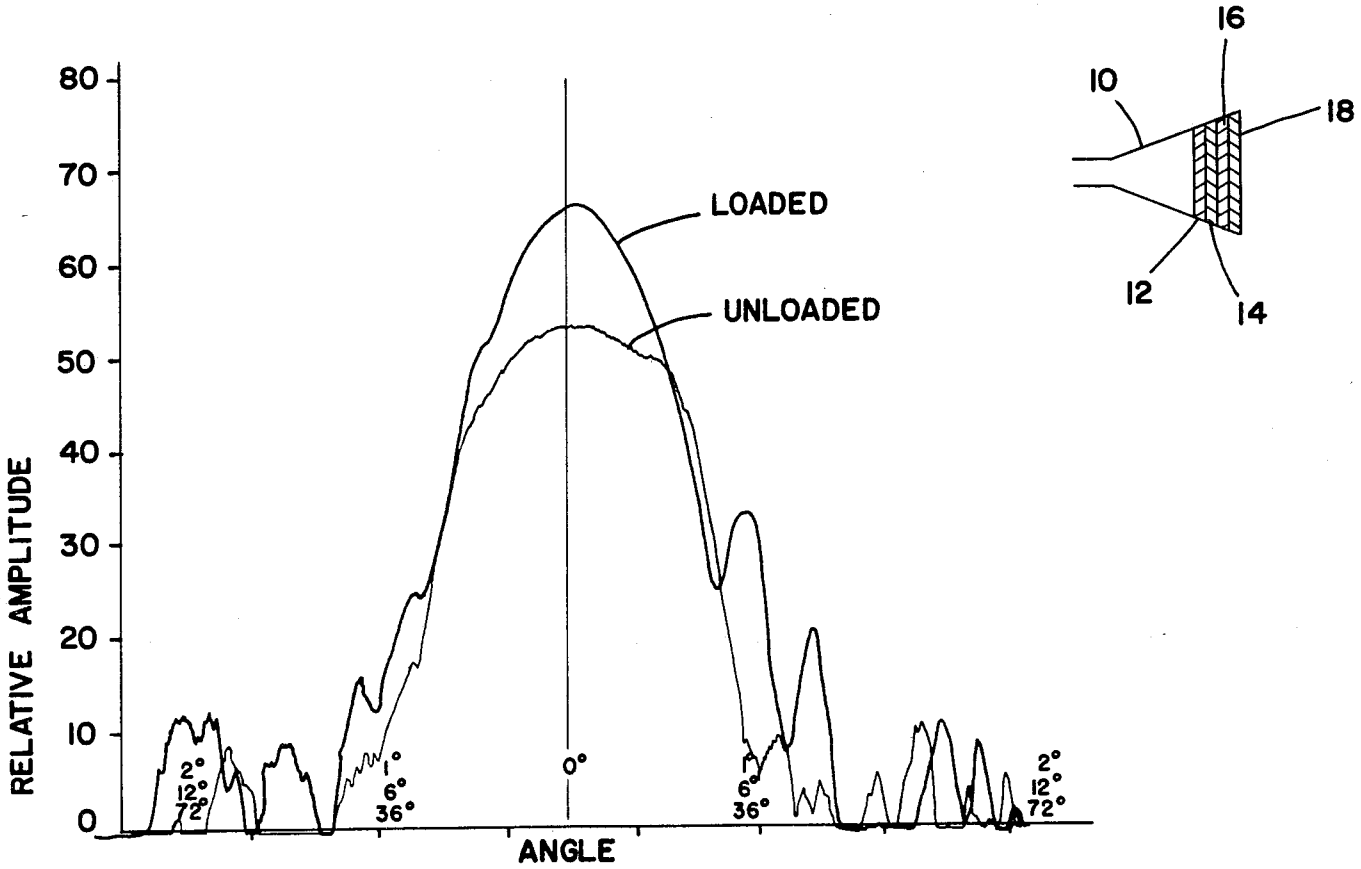
FIG. 1 is a longitudinal section view of one embodiment of a dielectric array transversely loading a horn antenna and a plot of the relative axial gain of the loaded horn vs. an unloaded one.

Referring to FIG. 1, a longitudinal section view of an H-plane sectoral horn antenna 10 is shown in which four dielectric strips 12, 14, 16, 18 are arrayed adjacent one another and transversely in the horn. The outermost dielectric strip 18 is flush with the aperture external dimensions. Although the principal embodiment described is an H-plane sectoral horn, the invention is equally applicable to other geometric shapes. Also, many varieties of commercially available dielectric materials may be used as the essential characteristic is not the type of dielectric but the number of layers, thickness of each layer and relative permittivity of each layer of the array. Examples of commercially available, easily workable dielectrics are plastic composites known as STYCAST 0005, STYCAST HIK and STYCAST ECCOSTOCK GT-22. Also shown in FIG. 1 is a plot of the relative power transmitted for the horn antenna 10 unloaded and loaded with the dielectric strips 12, 14, 16, 18. For the instant case, each strip was 0.75 cm thick and the relative permittivity of the innermost strip, 12 was 4 represented as $\epsilon_{12}=4$. Other values were: $\epsilon_{14}=3$; $\epsilon_{16}=2.54$ and $\epsilon_{18}=1.46$. Axial gain and beam narrowing of a loaded horn over an unloaded one is achieved at the expense of increased sidelobe levels. Table 1 shows a comparison of the VSWR and relative percent power radiated of the loaded and unloaded horn as a function of frequency. Axial gain with the four-strip array increased 5.9 dB at 9.158 GHz.

TABLE 1

| | VSWR | | % Power Radiated | |
|---|---|---|---|---|
| Frequency | Unloaded | Loaded | Unloaded | Loaded |
| 8 GHz | 1.43 | 1.21 | 96.87 | 99.1 |
| 8.5 GHz | 1.57 | 1.115 | 95.08 | 99.7 |
| 9 GHz | 1.35 | 1.88 | 97.84 | 90.66 |
| 9.5 GHz | 1.45 | 1.545 | 96.63 | 95.41 |
| 10 GHz | 1.47 | 1.99 | 96.44 | 89.04 |
| 10.5 GHz | 1.13 | 1.145 | 99.65 | 99.54 |
| 11 GHz | 1.24 | 1.09 | 98.89 | 99.81 |
| 11.5 GHz | 1.26 | 1.73 | 98.72 | 92.85 |
| 12 GHz | 1.22 | 1.48 | 99.03 | 96.25 |

Figure 2:
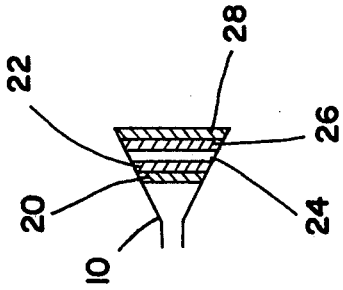
FIG. 2 is a longitudinal section view of another embodiment of a dielectric array containing an air gap transversely loading a horn antenna and a plot of the relative axial gain of the loaded horn vs. an unloaded one.
Figure 2:
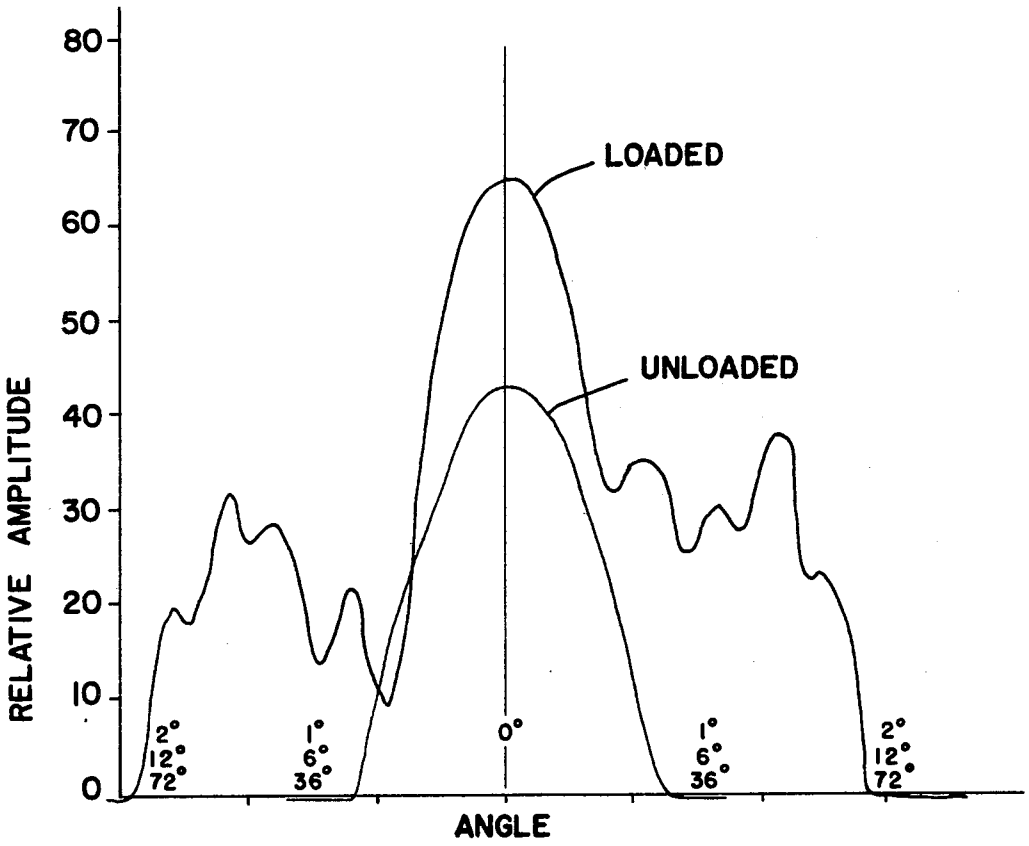

A second embodiment is shown in FIG. 2. Here, the horn antenna 10 is loaded with an array of four dielectric strips and an air gap 20, 22, 24, 26, 28 in which the middle strip 24 is the air gap. Shown beneath the section view of the loaded horn is a plot of the relative power transmitted for the unloaded horn and the horn loaded with the strips and air gap. The relative permittivities in this case were: $\epsilon_{20}=5$; $\epsilon_{22}=4$; $\epsilon_{24(air)}=1$; $\epsilon_{26}=2.54$ and $\epsilon_{28}=1.26$. Thicknesses of the air gap and strips were all 0.75 cm. Again axial gain was found to increase 10 dB over the unloaded case and the main beamwidth decreased from 35.5° to 22° at the cost of increased sidelobes. Table 2 shows a comparison of VSWR and relative percent power radiated of the loaded horn with and without the air gap in the array as a function of frequency.

TABLE 2

| Frequency | VSWR (No Air Gap) | VSWR (0.75 cm Air Gap) | % Power Radiated (No Air Gap) | % Power Radiated (0.75 cm Air Gap) |
|---|---|---|---|---|
| 8 GHz | 2.55 | 3.95 | 80.94 | 64.48 |
| 8.5 GHz | 1.143 | 3.43 | 99.55 | 69.91 |
| 9 GHz | 1.92 | 3.65 | 90.07 | 67.52 |
| 9.5 GHz | 2.53 | 2.76 | 81.21 | 78.09 |
| 10 GHz | 1.415 | 3.3 | 97.95 | 71.39 |
| 10.5 GHz | 1.198 | 5.12 | 99.19 | 54.47 |
| 11 GHz | 2.7 | 3.7 | 78.89 | 67 |
| 11.5 GHz | 2.75 | 2.25 | 78.22 | 85.21 |
| 12 GHz | 2.79 | 2.23 | 77.69 | 85.5 |

Figure 3:
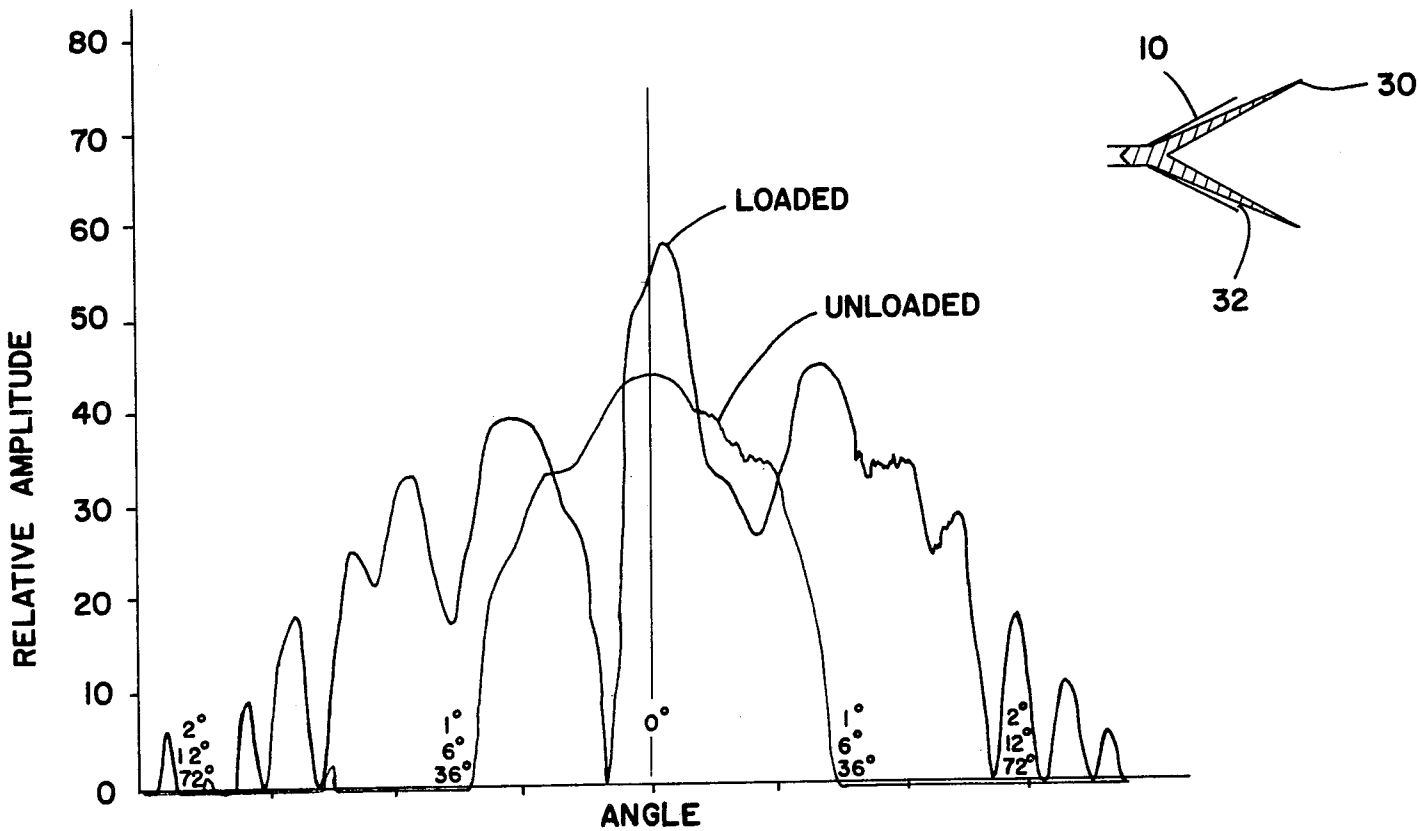
FIG. 3 is a longitudinal section view of a dielectric array longitudinally loading a horn antenna and a plot of the relative axial gain of the loaded horn vs. an unloaded one.

$\epsilon_{20}=5$, $\epsilon_{22}=4$, $\epsilon_{24}=1$ (air gap), $\epsilon_{26}=2.54$, $\epsilon_{28}=1.46$
$d_1=d_2=d_3=d_4=d_5=0.75$ cm A third embodiment of dielectric loading of horn antennas is shown in FIG. 3. Here, the antenna horn 10 is loaded with a V-shaped dielectric plug 30 in which the apex of the plug extends a short distance into the feed waveguide and the arms extend along and slightly beyond the antenna walls. The extended arms of the dielectric plug are separated from the horn walls by a critical air gap 32 determined by the particular horn geometry, dielectric and frequency used. In the instant case $\epsilon_{30}=3$, d=1 mm and f=9.077 GHz for the plot of relative radiated power for the loaded and unloaded horn shown in FIG. 3. For the longitudinally loaded case, axial gain increase and beam narrowing occur as they do with transverse loading. However, with longitudinal loading beam narrowing is considerably greater making the technique very valuable for highly directional communication antennas. Additionally, where the antenna aperture is longitudinally loaded, partial non-mechanical angular sweeping of the main beam is achieved by partial frequency sweeping around the center frequency of the input signal in the feed waveguide. Angular sweeps of as much as 14° were achieved.

Figure 4:
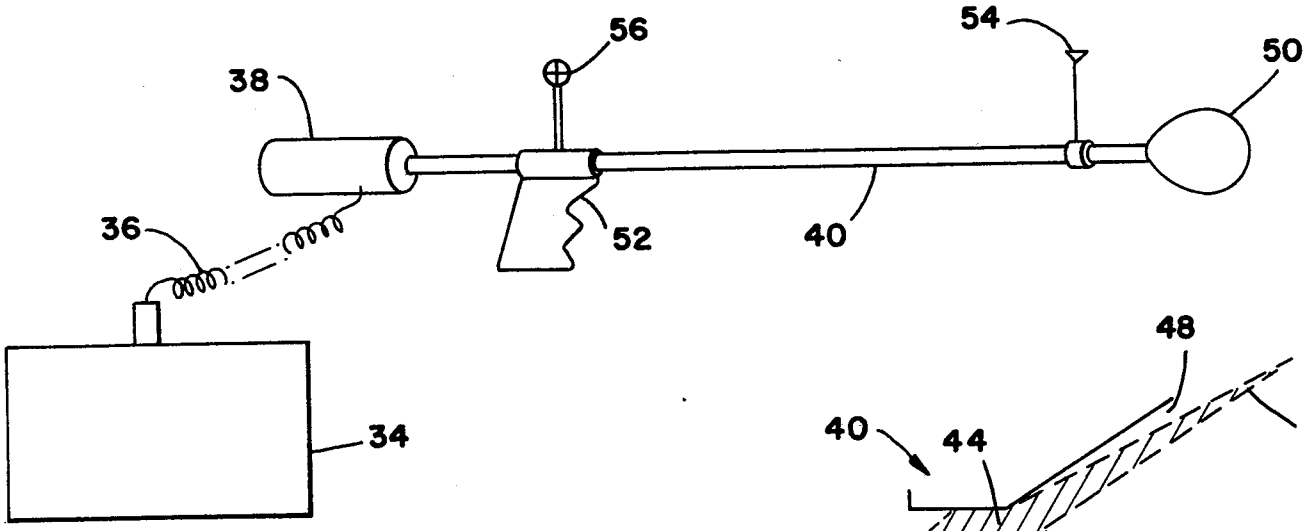
FIG. 4 is a schematic of a line-of-sight microwave communication system employing an antenna of FIG. 3 as shown in FIG. 4A.
Figure 4A:
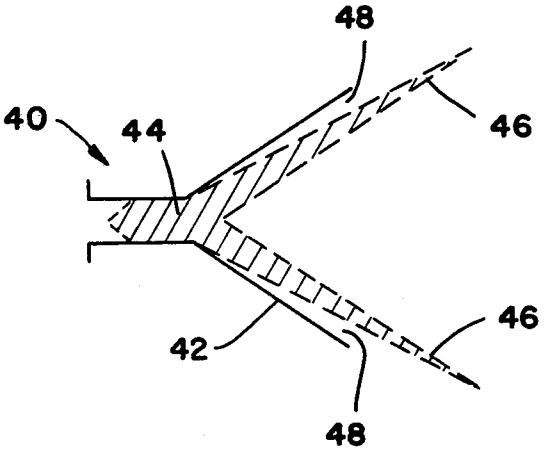

Referring to FIGS. 4 and 4A, a schematic diagram of a portable, line-of-sight communication device using the technique of longitudinal loading as taught in embodiment three is shown. A power supply and control pack 34 transmits energy via a cable 36 to a Gunn oscillator 38 which generates an input signal into a circular waveguide 40 terminating into a horn antenna 42 longitudinally loaded with a V-shaped dielectric plug 44 having extended arms 46. The arms 46 are separated from the antenna walls by an air gap 48. A randome housing 50 of low relative permittivity material protectively surrounds the horn and plug insert and is attached to the feed waveguide. The device is held by a pistol grip 52 and aimed by means of a front sight 54 and rear sight 56.

What is claimed is:

1. A means of improving the axial grain and narrowing the main beam of a microwave radiation system having an aperture antenna comprising:

(a) inserting a first dielectric slab of uniform relative permittivity into said aperture antenna to a predetermined depth in said aperture antenna, said first slab having a uniform thickness in the direction of propagation of said beam and extending completely between all four walls of said aperture antenna;

(b) inserting a second dielectric slab of uniform relative permittivity adjacent said first dielectric slab, said second slab having uniform thickness in the direction of propagation of said beam and extending completely between all said four walls of said aperture antenna;

(c) inserting a third dielectric slab of uniform relative permitivity adjacent said second dielectric slab, said third slab having uniform thickness in the direction of propagation of said beam and extending completely between all said four walls of said aperture antenna; and (d) inserting a fourth dielectric slab of uniform relative permittivity adjacent said third dielectric slab, said fourth slab having uniform thickness in the direction of propagation of said beam and extending completely between all said four walls of said aperture antenna and having the opposite face of said fourth slab flush with the outer dimensions of said aperture antenna, the thickness of all of said dielectric slabs being the same.

2. A means of improving the axial gain and narrowing the radiated beam of a microwave radiation system as recited in claim 1 wherein said second and said third dielectric slabs are separated by an air gap.

3. A means of improving the axial gain and narrowing the radiated beam of a microwave radiation system as recited in claim 2 wherein said air gap has the same thickness of each of said dielectric slabs.

* * * * *